US007040949B2

(12) United States Patent
Slocum

(10) Patent No.: US 7,040,949 B2
(45) Date of Patent: May 9, 2006

(54) FLEXIBLE CONNECTOR

(75) Inventor: Alexander H. Slocum, Bow, NH (US)

(73) Assignee: AESOP, Inc., Concord, NH (US)

( * ) Notice: Subject to any disclaimer, the term of this patent is extended or adjusted under 35 U.S.C. 154(b) by 0 days.

(21) Appl. No.: 10/909,628

(22) Filed: Aug. 2, 2004

(65) Prior Publication Data

US 2006/0025034 A1 Feb. 2, 2006

(51) Int. Cl.
*A63H 33/12* (2006.01)

(52) U.S. Cl. ..... 446/122; 446/124

(58) Field of Classification Search ..... 446/119–126, 446/85; 441/122–132; D21/486
See application file for complete search history.

(56) References Cited

U.S. PATENT DOCUMENTS 2,587,798 A * 3/1952 Wilcox ..... 446/109
3,603,026 A * 9/1971 Kishigami ..... 446/122
D410,973 S * 6/1999 Jensen ..... D21/486
D420,710 S * 2/2000 Poulsen ..... D21/486
6,132,276 A * 10/2000 Leemon ..... 441/129
6,478,649 B1 * 11/2002 Hoback ..... 446/85
6,554,677 B1 * 4/2003 Leemon ..... 446/122

* cited by examiner

*Primary Examiner*—Kien Nguyen
(74) *Attorney, Agent, or Firm*—Rines and Rines

(57) ABSTRACT

A structural connection device to be used primarily as a toy in conjunction with foam tubes, popularly known as "noodles" which are commonly used at swimming pools, wherein the connector is preferably made from foam and is configured as a longitudinal flexible member with a pattern of holes, each of which is slightly smaller than the diameter of a typical noodle, such that a noodle can be press-fit into a connector strip hole to act as a structural node; and because the connector may be made from foam, particularly for toy use, it can be bent and twisted, therefore enabling one simple element to act as a complex-shaped node into which many noodles can be inserted and used in conjunction with other connectors to build complex structures. Because the connector and the noodles are flexible, together they have immense play value because users are not limited by fixed angles and rigid members; and, indeed, because the elements are flexible, users learn to use proper diagonal bracing methods in order to provide stability to the structures. When made from a resilient material such as rubber, the connector can also be used with hard structural members, such as plastic pipe, to rapidly construct emergency structures.

15 Claims, 8 Drawing Sheets

FLEXIBLE CONNECTOR

The present application contains the disclosure of a provisional application entitled "Flexible Structural Connector" filed on or about May 28, 2004.

STATEMENT REGARDING FEDERALLY FUNDED RESEARCH

No federal funds were used in the development of this invention

FIELD OF THE INVENTION

The present invention relates to flexible structural connectors to enable the creation of truss-type structures, but more particularly, but not exclusively, to the creation of toy structures. Although the first preferred embodiment uses foam as the material from which the connector to join other foam components such as "noodles" used in swimming pools, a rubber version, for example, would enable the connector to be used with hard "real" structural elements such as plastic pipe to enable the rapid construction of structures such as might be used for emergency construction.

BACKGROUND OF THE INVENTION

There are a great many toy construction sets on the market and a great many toys which are based on the theme of construction sets. Most construction sets have been made out of dense and hard materials, and do not enable flexile free-form connections. Even the prior foam connectors sold for toy "noodles", or the connectors of the type described in our earlier U.S. Pat. No. 6,641,453, while extremely useful, are, however, limited to intersections at fixed rigid angles, relying on the flexibility of the noodles to achieve non-standard angles. This can limit the toy-play experience by the users.

U.S. Pat. No. 5,498,190 describes a toy for making sculptures where foam blocks with holes can be used as connectors for other foam structures with wire cores; however, it is not suited for use as a structural connection system that join many structural elements at a node to form a truss-type structure.

There are, moreover, a vast plethora of node constructions that have been designed for building construction systems, such as for modular trusses; but, they also appear to focus on fixed and/or rigid angle designs.

The technique and designs of this invention, on the other hand, readily and simply overcome these limitations both in the area of toys and in the more general areas of construction structures. They preferably involve the use of plastic foam, rubber or other flexible and resilient material for supporting transversely extending noodles or other construction elements, that may also be flexible as of foam for toys or more structural as of PVC pipe where appropriate. This allows the noodles or other structural elements to be detachably pressed into the connectors, with the connectors themselves being locally very flexible in bending, yet relatively strong in shear. The effect therefore is somewhat akin to lashing poles together with string: many poles can be brought together at a joint, and then all connected with string. In this case, however, instead of the time-consuming process of lashing, the invention uses a flexible (resilient) strip of material itself laced with holes that grip the structural elements pressed through them. The result is a connection method for truss-type structures that can be used as a toy, or on the other hand, where desired, as a building or construction technique for low-cost rapid assembly of structures, such as is required for emergency construction applications.

OBJECTS OF THE INVENTION

A principal object of this invention, therefore, is to provide a new and improved method or technique of and structures for attaining above-described novel features while obviating the limitations of prior structures of this type, and through the provision of longitudinally extending flexible connector strips or members, joining pluralities of transverse structural elements at a plurality of nodes formed therealong, wherein the angles at which the respective structural members transversely supported by the connector strips at the corresponding nodes are restrained and accommodated for, by the flexibility of the longitudinal connector strips.

A further object of this invention is to provide such a novel flexible strip connector that can resiliently grip structural elements pressed transversely into successive holes formed as a flexible linkage therein and therealong.

Another object is to provide such a connector strip that can be made of foam and is particularly adapted used with foam swimming pool noodles and the like.

Other and further objects will be explained hereinafter and more particularly delineated in the appended claims.

SUMMARY

In summary, however, the invention embraces in a flexible construction set, a longitudinally extending flexible connector strip formed as a linkage of successively connected transverse holes serving as connector nodes for receiving respective structural elements transversely press-fitted into the corresponding holes for node-connection thereat.

In the previously described use of the invention as a toy for use with foam tubes, popularly known as "noodles" and which are commonly used at swimming pools, the longitudinal connector strip is preferably made from flexible foam, similar to that used for the noodles, and is configured as a long member with a pattern of successive transverse holes, each of which is made slightly smaller than the diameter of the typical noodle. The connector strip, as earlier mentioned, can also be made from flexible plastic or rubber, but foam ensures that it will float and that it is also soft so that if swung or thrown, it will not cause injury. The holes are sized so that each noodle element pressed into a connector hole can serve as a structural node. Since the connector strip is made from foam, or other flexible material, moreover, it can be bent and twisted, thereby enabling it to assume complex-shapes such that many noodles can be inserted and used in conjunction with other connector links to build complex structures. Because the connector and the noodles are flexible, moreover, together they have immense play value because users are not limited by fixed angles and rigid members, and indeed, because the elements are flexible, users may learn how to achieve proper diagonal bracing in order to provide stability to the structures. When made from a resilient material such as rubber, the connector can accommodate hard structural members, such as plastic pipe, as before mentioned, to rapidly create emergency structures.

Best mode and preferred designs and techniques will now be described.

DRAWINGS

The present invention can best be understood in conjunction with the accompanying drawing, in which.

Figure 7:
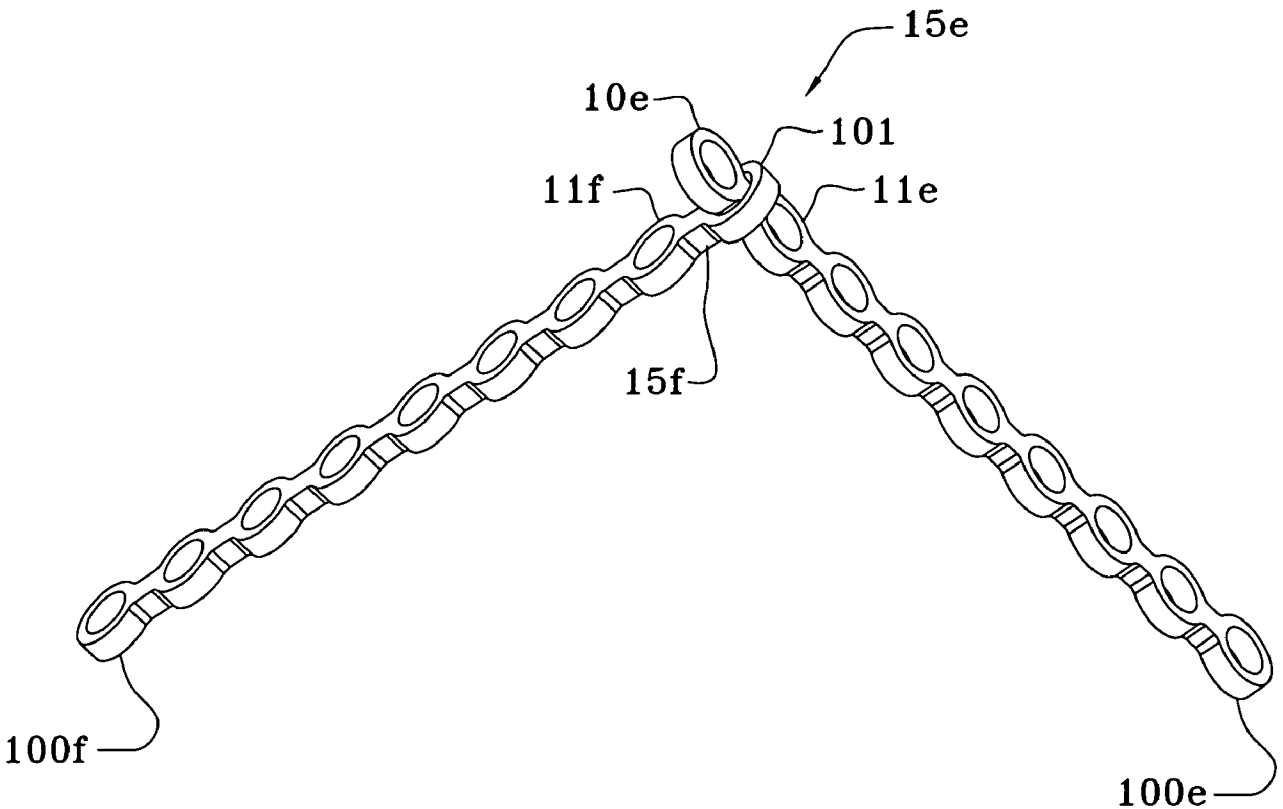

FIG. 7 isometrically illustrates a pair of mating connector strips; and

Figure 8:
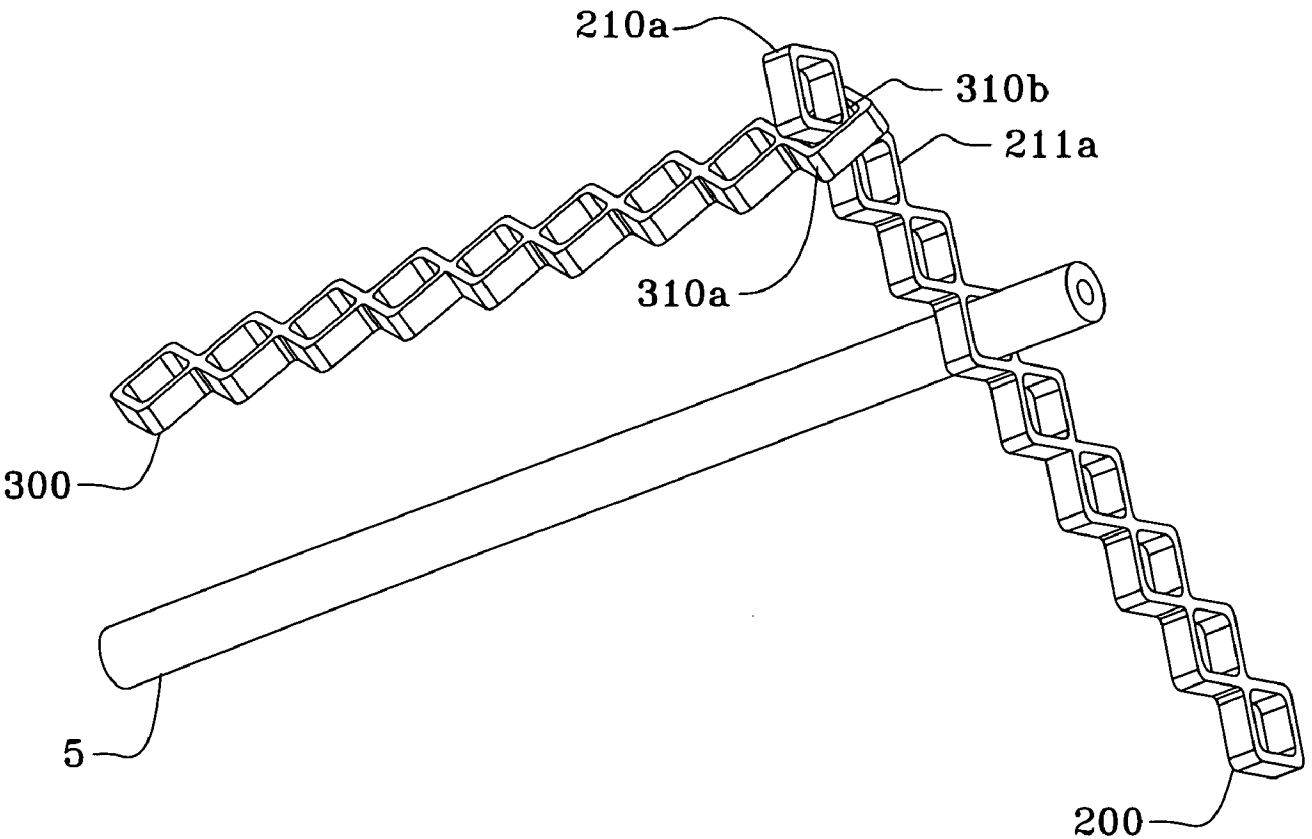

FIG. 8 shows a polygon (square) shape for the connector strip holes and with a longitudinal bridging "septum" between successive holes of the linkage to increase torsional compliance.

In the drawings, preferred embodiments of the invention are illustrated by way of example, it being expressly understood that the description and drawings are only for the purpose of illustration and preferred designs, and are not intended as a definition of the limits of the invention.

PREFERRED EMBODIMENT(S) OF THE INVENTION

Figure 1:
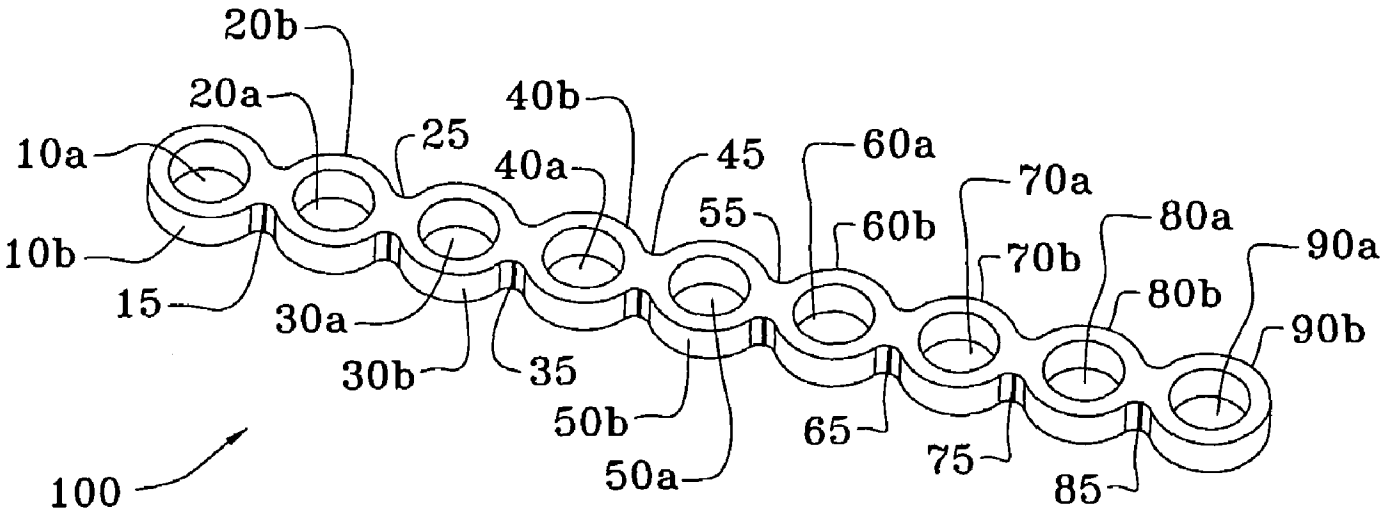
FIG. 1 is an isometric view of a preferred longitudinally extending flexible connector in its stress-free state formed as a linkage of a plurality of successive transverse nodal holes for receiving structural members inserted transversely within the holes.
Figure 2:
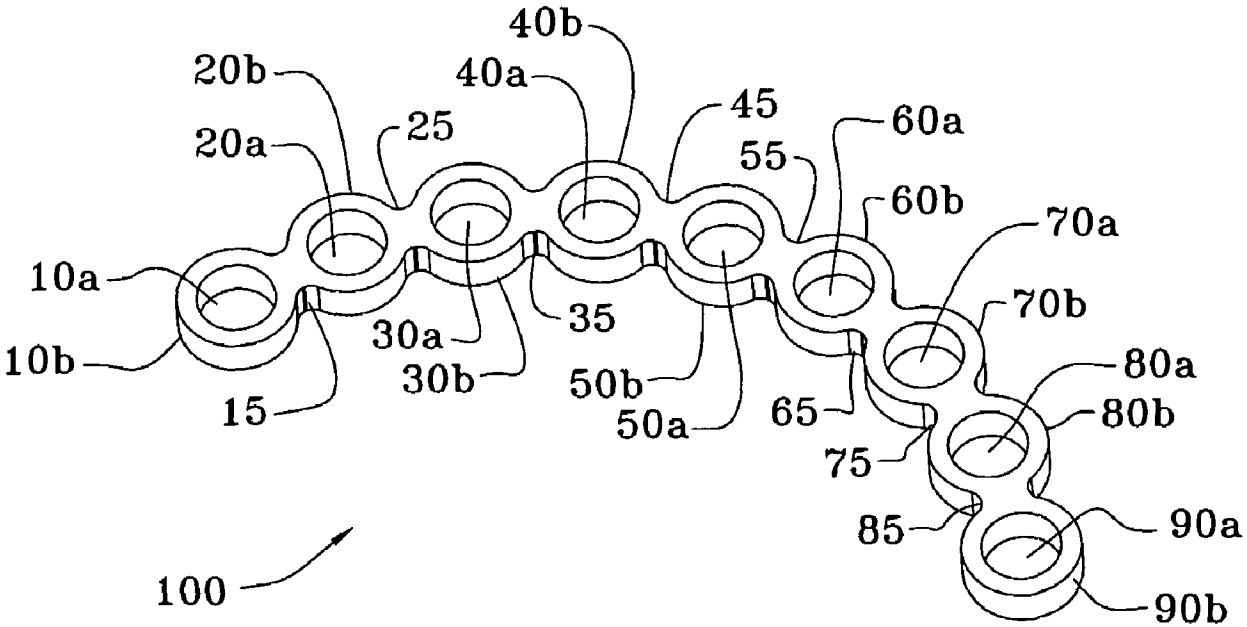
FIG. 2 is a similar view of the connector strip of FIG. 1 in a bent shape.

FIG. 1 shows a flexible-material longitudinally extending connector strip 100 formed in accordance with the present invention, preferably of foam plastic of the like, and in its stress-free state; and FIG. 2 shows it as easily bent to form an arc, where, if desired, it may be constrained or allowed to bend back. The flexible connector strip is shown formed as a linkage of successively connected transverse holes 10*a*, 20*a*, 30*a*, 40*a*, 50*a*, 60*a*, 70*a*, 80*a*, and 90*a*, the holes serving as connector nodes for receiving nominally cylindrical elements, including polygon elements, such as rods or tubes or the like, shown as 5*a*, 5*b* etc. in FIG. 4. The holes are preferably made smaller than the cylindrical structural elements, so that the cylindrical structural elements may be transversely press-fitted into corresponding holes for node-connection thereat. Each hole is defined respectively by the strip material 10*b*, 20*b*, 30*b*, 40*b*, 50*b*, 60*b*, 70*b*, and 80*b* which in this case is circular. The circles of the linkages are preferably nominally tangent to one another, and rounded regions 15, 25, 35, 45, 55, 65, 75, 85 fill in between them and prevent stress concentrations. These regions also help to provide flexibility to the connector strip 100, while still maintaining reasonable shear-strength.

Figure 3:
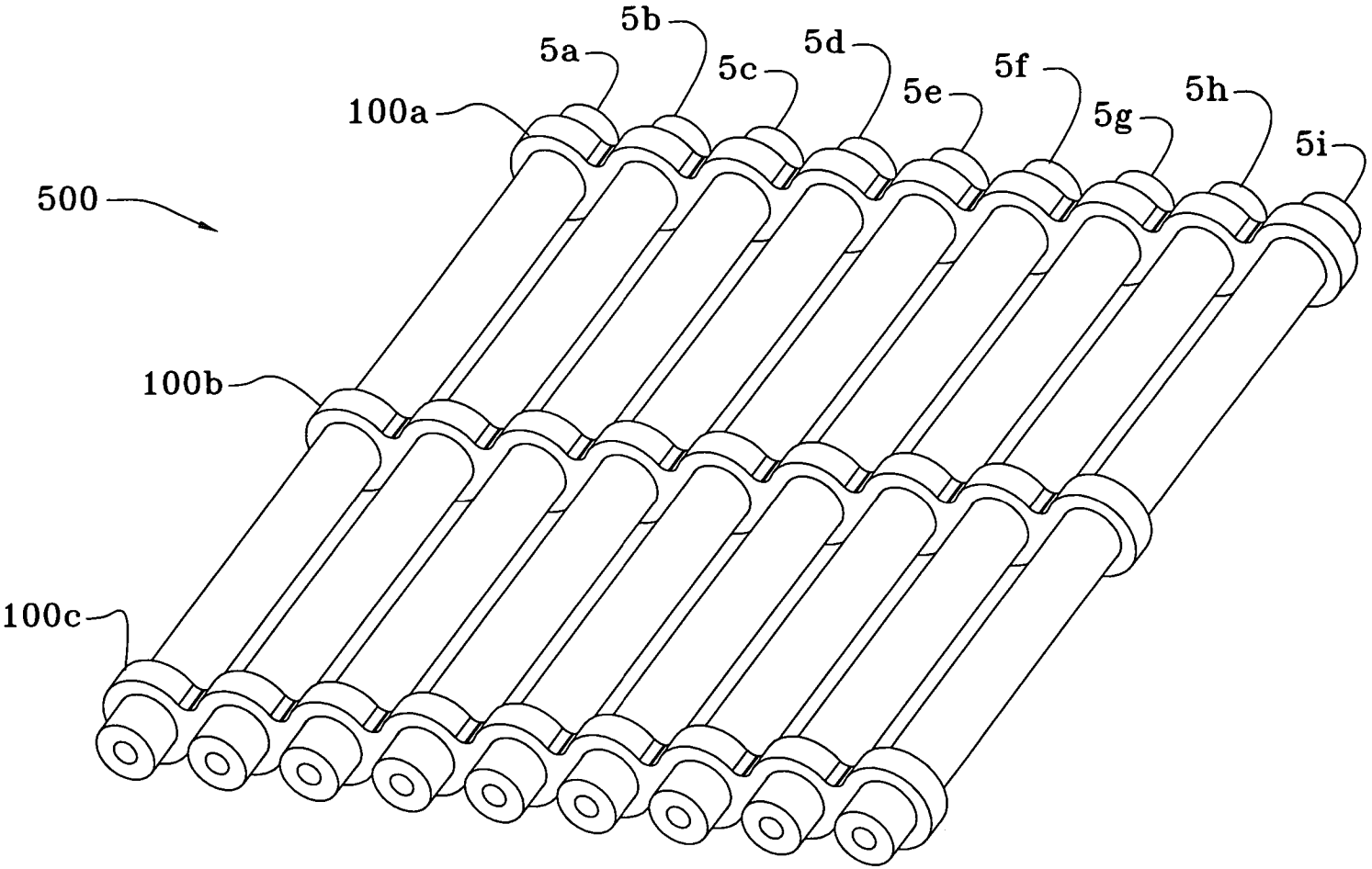
FIG. 3 illustrates three connector strips used with nine structural members to make a toy or other raft.

FIG. 3 shows an example of the type of simple play or other type of structure 500, such as a raft, that can be easily created. Strip linkage connectors 100*a*, 100*b*, and 100*c* grip structural cylinders 5*a*, 5*b*, 5*c*, 5*d*, 5*e*, 5*f*, 5*g*, 5*h*, and 5*i*. When the connectors and cylinders are both made from foam, a floating toy pool raft is created. When the connectors and cylinders are made from rubber and plastic or bamboo or the like, a structural mat is created, with on-axis flexibility, such as for creating a divider or a shelf to be supported by a frame.

Figure 4:
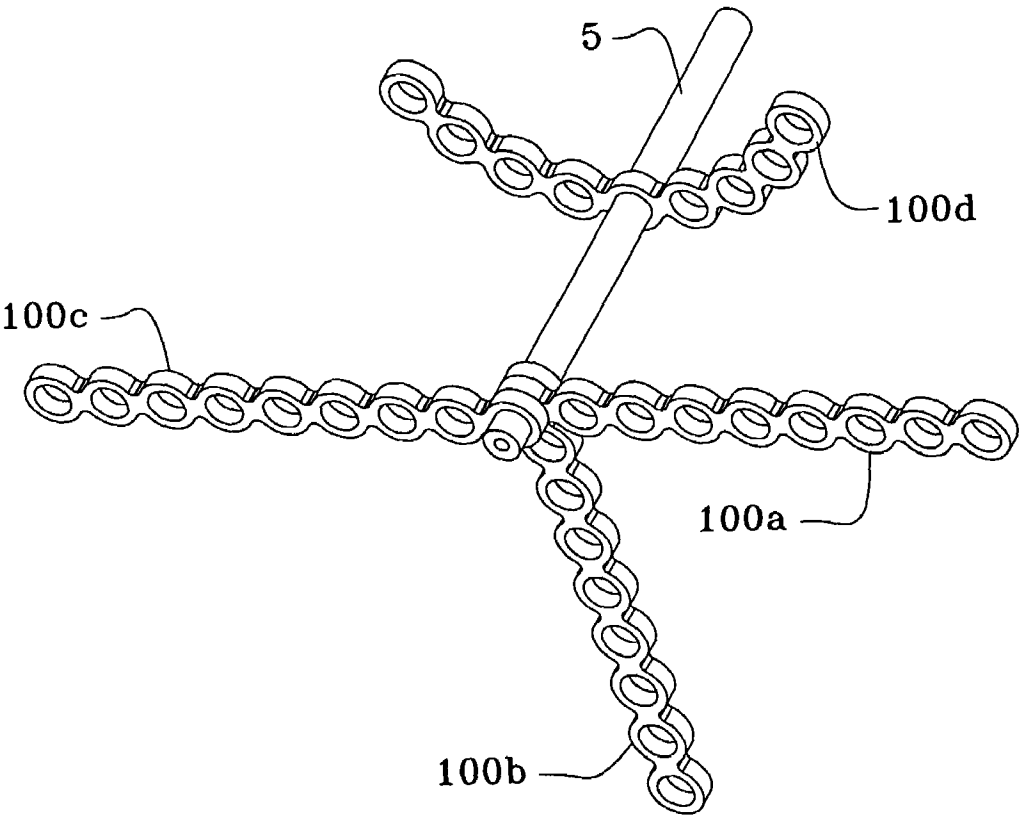
FIG. 4 illustrates a subassembly comprised of a simple structural member with three connector strips on one end, and a bent connector strip in the middle.

FIG. 4 shows a subassembly of a noodle or other structural element 5 onto which strip connectors 100*a*, 10*b*, 100*c*, and 100*d* have been pressed. Connector 100*d* is shown bent as it would be if it was held bent just prior to connecting to other noodles.

Figure 5:
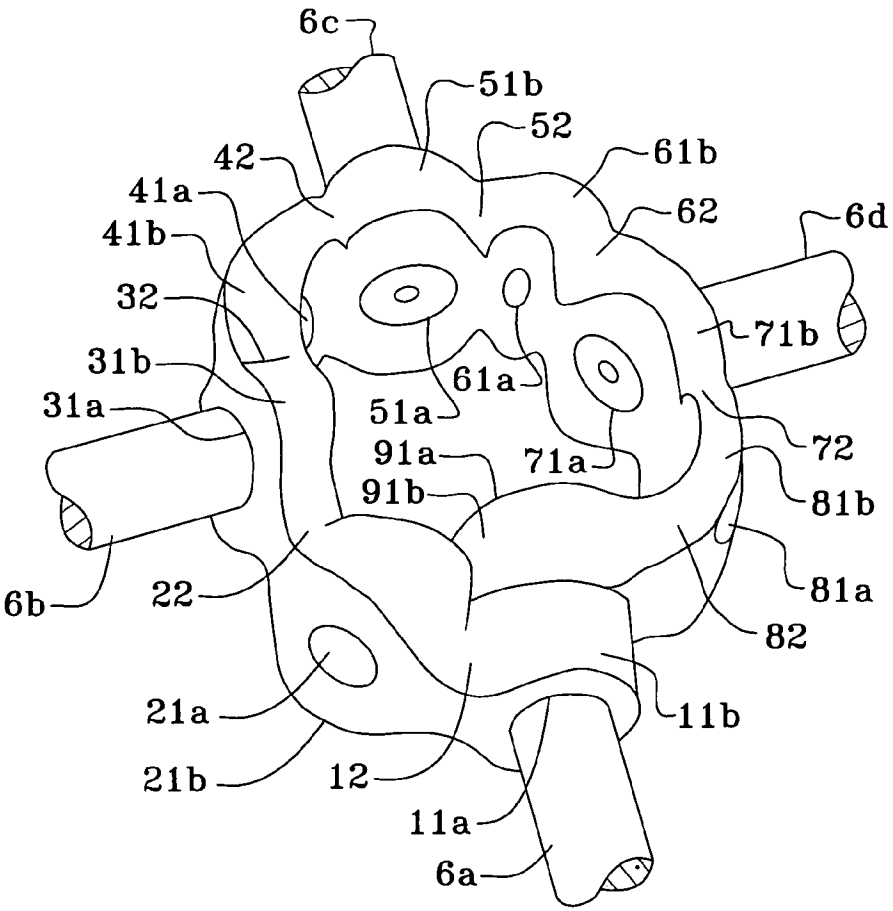
FIGS. 5 and 6 illustrate a connector strip twisted or bent out-of-plane to form complex three dimensional attachment nodes.

FIG. 5 illustrates how the use of nine holes may allow the connector strip 101 to be bent into a circle, where hole 91*a* and 11*a* line up and both grasp cylinder 6*a*. This allows cylinders 6*b*, 6*c*, and 6*d* to be held by holes 41*a*, 51*a*, and 71*a*, respectively. Holes 31*a*, 41*a*, 61*a*, and 81*a* are then at 45-degree angles to the cylinders and thus could hold cylinders as radial members or diagonal stiffening elements, as desired.

Figure 6:
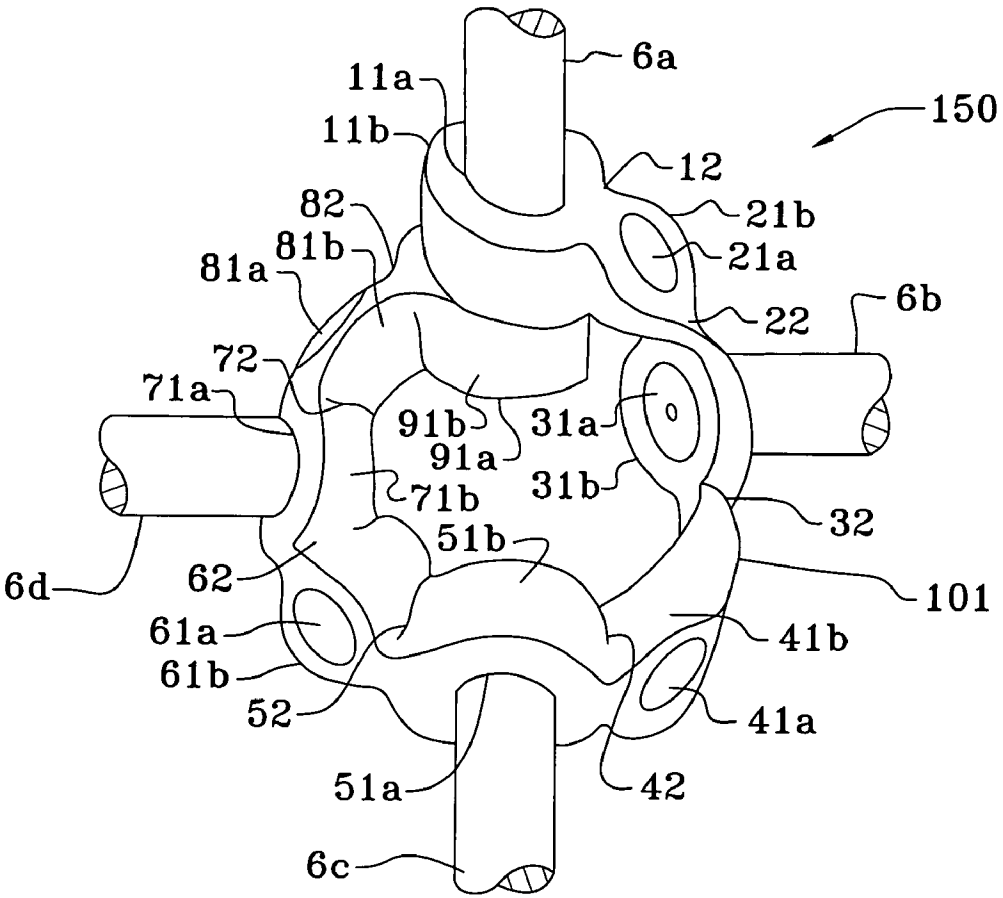

FIG. 6 shows how the flexibility of the connector strip can be used to allow the planar application shown in FIG. 5 to become three-dimensional by simply bending or twisting up one of the cylinders, such as 6*a*. The holes/structure 21*a*, 21*b*,12,22 and 81*a*, 81*b*, 72, and 82 primarily deform to accommodate the 90-degree direction of member 6*a*. The cylindrical structural members are shown not intersecting for purposes of clarity and to allow more joint flexibility. To stiffen the joint, however, they may be made to protrude into the joint until their ends touch.

Ideally the connector strips are extruded and cut to thickness using a traveling shear or waterjet or other soft-material cutting device; however the array of holes may merely be cut from a long rectangular member, but this would use more material and decrease out-of-plane flexibility. They can also be cut, e.g., using a high pressure waterjet, from a rectangular plank of material, particularly for prototyping purposes. They could also be injection molded. If made of rubber sheet, they can be die-cut.

FIG. 7 shows how the connectors can also mate with themselves. The septum 15*f* spaces the holes 10*f* and 11*f* apart so another hole can fit over it more easily. It also allows the connector strip to be twisted as shown in FIG. 6. In FIG. 7, hole 10*f* of connector strip 100*f* is over septum 15*e* and is held in place on either side by holes 10*e* and 11*e* of the connector strip 100*e*.

The holes need not just be of round or circular shape. FIG. 8 shows connectors 200 and 300 made from polygon (such as square) sections connected together by longitudinal septums. As in FIG. 7, the two connector strips are shown mated to each other. Because they are preferably made of soft foam, square section 310*a* can be pushed over square section 210*a* so that its inside 310*b* surrounds the septum (not visible) that connects square section 210*a* to 211*a*. The use of the square section enables a round noodle 5 more easily to fit inside even if there is a large tolerance (even on the order of several mm) because the sides of the polygon can bend outwards. It should be noted, moreover, that the polygon does not have to have all straight sides, but it can be made up of rounded sections that create an undulating pattern if desired. The goal is to increase the outward radial compliance of the shape, and methods for achieving this are known to those skilled in the art of the design of structures, and in particular, flexural members.

The linear arrays of holes can also contain more or less than the illustrated nine holes. In addition, the thickness of the foam-material connector strips is shown here to be preferably on the order of the hole diameter, or cross-dimension, say on the order of 1–3 inches more or less, which would be ideal if the connector were to be made of foam. However, if made of rubber, then the thickness could be much smaller, on the order of 5 mm thin (3–10 mm depending on the size of the hole). In addition, the inside surface of the hole could have features, such as protrusions, to give extra flexibility for accommodating different-sized transverse cylinders or non-round shapes, and to help better grip the inserted members.

All such variants are considered within the scope of the invention of using the flexible connection strips of the invention that can be deformed in three dimensions.

In a third preferred embodiment, more than just a linear or planar array of holes linked together by structure can be created. Two rows, a T, or a +shaped array may also be used. When molded, the holes axes can even be at angles to one another, including out-of-plane. In addition, the connector may have fewer or more holes as desired. In all these embodiments, however, the goal is to allow the user to easily create a structure by providing flexible members that elastically slide over structural members to hold them tight, and allow their ends to transmit forces between each other.

Further modifications of the invention will also occur to persons skilled in the art, and all such are deemed to fall within the spirit and scope of the invention as defined by the appended claims.

What is claimed is:

1. In a flexible construction set, a longitudinally extending flexible connector strip formed as a linkage of successively connected transverse holes serving as connector nodes for receiving respective structural elements transversely press-fitted into the corresponding holes for node-connection thereat, the thickness of the strip being on the order of a cross-dimension of the holes.

2. The construction set of claim 1 wherein the connector strip is of resilient foam material.

3. The construction set of claim 2 wherein the transverse thickness of the foam connector strip is about the same dimension as a cross dimension of the linkage holes.

4. The construction set of claim 2 wherein the cross dimension of the linkage holes is made just less than that of the transversely received structural elements.

5. The construction set of claim 4 wherein the transverse holes are one of substantially circular and polygonal shape.

6. The construction set of claim 4 wherein the transverse holes are oblong shaped.

7. The construction set of claim 1 wherein the connector nodes are arranged in a flat or planar linear fashion with the holes interconnected successively by bridging strip material.

8. The construction set of claim 1 wherein the connector strip is twisted out-of-plane by being bent to form a three dimensional connector structure.

9. The construction set of claim 1 wherein a hole link of a further similar flexible connector strip is resiliently fitted into one or more of the linkage holes of the first-named connector strip.

10. The flexible construction set of claim 1 wherein the holes are not round.

11. A method of flexibly connecting a plurality of transverse structural elements, that comprises, forming a longitudinally extending flexible strip of predetermined transverse thickness into a linkage of successively connected transverse holes of cross dimension of the order of said thickness and serving as connector nodes for the structural elements, and press-fitting successive elements transversely into the corresponding holes for node-connection thereat.

12. The method of claim 11 wherein the flexible strip is formed of foam plastic material.

13. The method of claim 11 wherein the flexible connector strip is twisted out-of-plane by bending to form a three-dimensional connector structure.

14. The method of claim 11 wherein a hole link of a further similar flexible connector strip is resiliently fitted into one or more of the linkage holes of the first named flexible connector strip.

15. In a flexible construction set, a plurality of longitudinally extending flexible strips each formed as a link of successively connected transverse holes of a cross dimension corresponding to the dimensional thickness of the strips serving as a set of connector nodes for receiving structural elements transversely press-fitted into corresponding holes of each of the connector strips to provide a three-dimensional structure held together by the connector strips, the connector strips being flexible to allow them to be twisted to allow the structural elements to be attached at three-dimensional angles with respect to each other.

* * * * *